United States Patent [19]

Hendricks et al.

[11] Patent Number: 4,613,337

[45] Date of Patent: Sep. 23, 1986

[54] PROCESS FOR DYEING CELLULOSE-CONTAINING FIBRE MATERIALS BY THE COLD PAD-BATCH OR PAD-STEAM METHOD: MALEIC ANHYDRIDE-STYRENE COPOLYMER

[75] Inventors: Udo W. Hendricks, Odenthal; Klaus Lesche, Overath-Brombach; Günter Sackmann; Wolf-Dieter Schröer, both of Leverkusen, all of Fed. Rep. of Germany

[73] Assignee: Bayer Aktiengesellschaft, Leverkusen, Fed. Rep. of Germany

[21] Appl. No.: 730,227

[22] Filed: May 3, 1985

[30] Foreign Application Priority Data

May 15, 1984 [DE] Fed. Rep. of Germany ..... 3417937

[51] Int. Cl.[4] ..... D06P 1/52; D06P 3/66

[52] U.S. Cl. ..... 8/543; 8/531; 8/532; 8/552; 8/557; 8/918

[58] Field of Search ..... 8/549, 543, 557

[56] References Cited

U.S. PATENT DOCUMENTS 3,368,987 2/1968 Pollart et al. ..... 428/511

4,036,587 7/1977 Wolf et al. ..... 8/557

4,264,324 4/1981 Chavannes et al. ..... 8/543

4,397,995 8/1983 Oftedahl et al. ..... 525/374

*Primary Examiner*—A. Lionel Clingman

*Attorney, Agent, or Firm*—Sprung Horn Kramer & Woods

[57] ABSTRACT

The dyeing of cellulose fibres or fibre blends containing cellulose fibres with reactive dyes by a cold pad-batch or pad-steam process is effected with aqueous padding liquors which contain water-soluble reaction products of copolymers of maleic anhydride and ethylene, propylene, isobutylene, diisobutylene or styrene with ammonia or amines of the formula

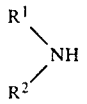

I in which $R^1$ and $R^2$ stand for hydrogen, $C_1$–$C_4$-alkyl or $C_1$–$C_4$-hydroxyalkyl.

16 Claims, No Drawings

PROCESS FOR DYEING CELLULOSE-CONTAINING FIBRE MATERIALS BY THE COLD PAD-BATCH OR PAD-STEAM METHOD: MALEIC ANHYDRIDE-STYRENE COPOLYMER

The present invention relates to a process for dyeing textiles in cellulose fibres or in fibre blends containing cellulose fibres, preferably in the form of tubular knits, with reactive dyestuffs by the cold pad-batch or pad-steam method. The process is characterised in that the textiles are padded with aqueous dyestuff liquors which contain water-soluble reaction products of copolymers of maleic anhydride and ethylene, propylene, isobutylene, diisobutylene and in particular styrene with ammonia or amines of the formula

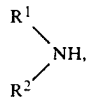

I in which $R^1$ and $R^2$ stand for hydrogen, $C_1$–$C_4$-alkyl or $C_1$–$C_4$-hydroxyalkyl.

Suitable reaction products contain recurring units of the formulae

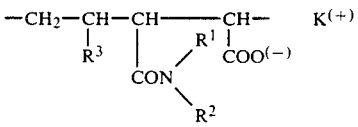

II

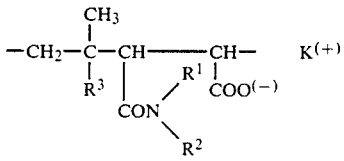

III in particular of the formula

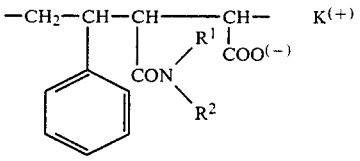

IV in which $R^3$ stands for hydrogen, methyl or $—CH_2—C(CH_3)_3$ and $K^{(+)}$ stands for hydrogen, any alkali metal ion, for example a sodium or potassium ion, or an ammonium ion of the formula

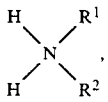

V and $R^1$ and $R^2$ are as defined in the formula I.

The molecular weight of the water-soluble reaction products which contain recurring units of formulae II, III or IV is $0.5\times10^5$ to $9.0\times10^6$, preferably $1.0\times10^6$ to $8.0\times10^6$.

To prepare the water-soluble reaction products, the copolymers are reacted at temperatures of 15° C. to 80° C. with ammonia or amines of the formula I and if desired alkali metal hydroxides, carbonates or bicarbonates, preferably in an aqueous medium. The resulting aqueous solutions are preferably added as such to the padding liquors. The reaction products can also be isolated from the reaction solution by known methods.

The copolymers can contain maleic anhydride on the one hand and ethylene, propylene, isobutylene or styrene on the other in varying amounts, but preferably the two components are used in equimolar amounts, and particularly preferred copolymers consist of maleic anhydride and styrene in equimolar amounts.

The molar ratio of maleic anhydride to ammonia or amine is for example 1:1–2.

The water-soluble reaction products to be used according to the invention are known per se. They are described for example in Houben-Weyl, Methoden der Organischen Chemie [Methods of Organic Chemistry] (1963), volume 14, part 2, pages 713 et seq., in British Patent Specification No. 1,082,122 and in European patent application No. 0,057,331.

The water-solubility of the reaction products can vary in a wide range. The concentration of the aqueous solutions which are added to the padding liquors is preferably such as to produce viscous, still readily pourable solutions. The concentration is in particular 2–30% by weight.

The water-soluble reaction products are added to the padding liquors in amounts of 0.1–5 g/l, preferably 0.4–1.0 g/l. The reaction products can also be added to the padding liquors combined with epsilon-caprolactam or urea in a weight ratio of about 1:0.5 to 1:2.

The padding liquors, in addition to the water-soluble reaction products to be used according to the invention and the reactive dyestuffs, contain the acid-binding agents required for fixing of the dyestuffs, such as alkalis, and can, if desired, also contain further customary auxiliaries, such as wetting agents.

The reactive dyestuffs can be any dyestuffs which can be used in pad-dyeing methods for cellulose materials. Suitable reactive dyestuffs are in particular those which contain at least one reactive substituent bonded to a 5- or 6-membered aromatic heterocyclic ring, for example to a pyridine, pyrimidine, pyridazine, pyrazine, thiazine, oxazine, or assymetrical or symmetrical triazine ring or to such a ring system which has one or more fused-on aromatic carbocyclic rings, such as a quinoline, phthalazine, cinnoline, quinazoline, quinoxaline, acridine, phenazine or phenanthridine ring system. Examples of reactive substituents on the heterocyclic system are: halogen (Cl, Br or F), ammonium including hydrazinium, sulphonium, sulphonyl, azido($-N_3$), thiocyanato, thio, thiolether, oxyether, sulphinic acid and sulphonic acid. Examples of suitable dyestuffs are described for example in Colour Index, 3rd edition (1971), volume 3, pages 3391–3560 and in K. Venkataraman "The Chemistry of Synthetic Dyes" vol. VI (1972).

The pad-dyeing process is carried out in accordance with known methods. The textiles, which are in web form, are first impregnated at temperatures between 5° C. and 40° C. with the padding liquor on a pad-mangle. In the cold pad-batch process, the dyestuffs are then fixed by plaiting the web or putting it on a batching roller and leaving it at temperatures of 20°–30° C. for between 6 and 48 hours. In the pad-steam process, the dyestuffs are fixed by treating the impregnated cloth at 102°-105° C. with the steam for 1-2 minutes. Suitable methods are described for example in "Der Textilbetrieb", 1976, No. 7-8, pages 43-45.

The process according to the invention can be carried out on woven and knitted fabrics in web form which are made of or contain cellulose, but in particular on tubular knits.

The presence of the abovementioned water-soluble reaction products in the padding liquor has the effect of significantly increasing the liquor pick-up for the same squeeze roller pressure, compared with a padding liquor not containing such a product. The liquor pick-up increases roughly in proportion with the starting concentration of the abovementioned products within the abovementioned application level range 0.1-5 g/l.

The depth of shade of the dye likewise increases in proportion with the liquor pick-up. There is no impairment of dyestuff fixation.

The increased liquor pick-up has a favourable effect on the result of the dyeing, especially in the case of dyeing tubular jersey material. There are always problems with levelness, even if special pad-mangles for tubular material are used. In particular in the case of material which is in the grey state, that is to say which has not been pretreated, the problem is that the inner surface of the tube is usually dyed unevenly and paler, due to insufficient penetration, and that the squeezed edges of the tube are distinctly marked in the form of longitudinal stripes. As a whole, the dyeing is usually also insufficiently level between areas.

If, on the other hand, the abovementioned water-soluable reaction products are added to the padding liquor, the previously mentioned defects can be remedied.

The higher liquor pick-up achievable by the addition leads to increased diffusion, that is to say the dyestuff migrates from areas of relatively high concentration to areas of relatively low concentration. In the batching phase, it is thus possible for non-uniform dyestuff application (for example due to non-uniform wetting of the textile material or variable liquor application at the squeezed edges) to be subsequently levelled out.

Furthermore, using the water-soluble reaction products distinctly raises the ability of the material to be dyed to hold the liquor, so that there is little tendency for the padding liquor on the rolled-up cloth to sink into the lower part of the cloth during the batching without rotation or during the plaiting, thereby avoiding an unlevel. outcome of the dyeing.

PREPARATION EXAMPLE 1

200 parts of ammoniacal water having an ammonia content of 21.4% are mixed with 4,000 parts of water. 150 parts of a styrene/maleic anhydride copolymer (molar ratio 1:1, viscosity $[\eta]=5.16$ dl/g) are slowly sprinkled in a little at a time at 45°-55° C., and the mixture is stirred at the same temperature until solution is complete. The highly viscous solution is then heated at 40°-50° C. to distil off about 300 parts of water/ammonia in vacuo, in order to remove excess ammonia. The degassed solution is adjusted to a solids content of 4.5% by adding water.

PREPARATION EXAMPLE 2

50 parts of an aqueous methylamine solution having a methylamine content of 30% are mixed with 800 parts of water. 30 parts of a styrene/maleic anhydride copolymer (molar ratio 1:1, viscosity index $[\eta]=4.86$ dl/g) are sprinkled in at room temperature, and the mixture is stirred at 50°-60° C. until solution is complete. The highly viscous solution is then heated at 40°-50° C. under reduced pressure to distil off about 170 parts of a water-methylamine mixture. The result is a highly viscous solution having a solids content of 5.6%.

PREPARATION EXAMPLE 3

105 parts of a diisobutylene/maleic anhydride copolymer (molar ratio 1:1, viscosity index $[\eta]=0.20$ dl/g) are added to a mixture of 200 parts of ammoniacal water and 200 parts of water, and the resulting mixture is stirred at 40°-50° C. until solution is complete. Excess ammonia is removed by evaporation in vacuo.

The result is a highly viscous aqueous solution having a solids content of 26%.

PREPARATION EXAMPLE 4

A highly viscous solution having a solids content of 26% is prepared in the same way as in Preparation Example 3 from 150 parts of ammoniacal water and 77 parts of an isobutylene/maleic anhydride copolymer (molar ratio 1:1, viscosity index $[\eta]=0.351$ dl/g).

PREPARATION EXAMPLE 5

21 parts of n-propylamine are mixed with 1,900 parts of water. 72 parts of a styrene/maleic anhydride copolymer (molar ratio 1:1, viscosity index $[\eta]=5.16$ dl/g) are slowly sprinkled in a little at a time at 40°-50° C., and the mixture is stirred at the same temperature until the solution is complete. The result is a highly viscous solution having a solids content of 4.7%.

PREPARATION EXAMPLE 6

26 parts of n-butylamine are stirred into a solution of 180 parts of $\epsilon$-caprolactam in 1,720 parts of water. 72 parts of styrene/maleic anhydride copolymer (molar ratio 1:1, viscosity index $[\eta]=5.16$ dl/g) are slowly sprinkled in a little at a time at 40°-50° C., and the mixture is stirred at 70°-80° C. until solution is complete. The result is a higly viscous solution having a solids content of 13.9%.

EXAMPLE 1

Untreated 1/1 rib cotton jersey is padded at room temperature on a pad-mangle for jersey under a squeeze roller pressure of 3 bar with a liquor which contains per litre of padding liquor:

- 25 g of the blue reactive dyestuff of Example 2 of British Pat. No. 1,014,055,
- 10 g of a commercially available anionic wetting agent
- 8 g of the product described in Preparation Example 1, in the form of its 4.5% by weight strength aqueous solution
- 20 g of anhydrous sodium carbonate 2.5 $cm^3$ of 32.5% strength sodium hydroxide solution.

The fixing alkali (sodium carbonate/sodium hydroxide) is metered into the box in the form of an aqueous solution using a metering pump. The liquor pick-up is 150%.

The padded cloth is batched up without edge overlap, is wrapped up air-tight and is left to rotate overnight at low speed. The dyeing is then finished in the same way by rinsing and soaping off at the boil. The result is a brilliant blue dyeing of remarkable levelness for untreated material.

If the product described in Preparation Example 1 is left out of the abovementioned recipe, then the same procedure and the same squeeze roller pressure produce a liquor pick-up of only 110%. In line with the lower liquor pick-up, the depth of the shade of the dyeing is 25% lower, as measured colorimetrically.

The fastness properties of the deeper dyeing are comparable to those of the paler dyeing.

EXAMPLE 2

Untreated grey-state cotton tubular knit fabric is padded at room temperature on a pad-mangle for jersey under a squeeze roller pressure of 3 bar with a liquor which contains per litre of padding liquor:

- 20 g of the yellow reactive dyestuff which is the 1st dyestuff in the table in columns 19/20 of DE-A-1,191,059 and
- 30 g of the red reactive dyestuff of Example 3 of DE-A-2,264,698,
- 10 g of a commerically available anionic wetting agent
- 8 g of a 4.5% strength solution of the product described in Preparation Example 1,
- 20 g of anhydrous sodium carbonate and 4 $cm^3$ of 32.5% by weight strength sodium hydroxide solution.

The fixing alkali (sodium carbonate/sodium hydroxide) is metered into the box in the form of an aqueous solution using a metering pump. The liquor pick-up is 155%.

The padded cloth is plaited with no edge overlap, is wrapped air-tight and is left overnight. Rinse and soap-off is effected in conventional manner (see Example 1).

The result is a full brilliant red dyeing of satisfactory penetration and levelness.

If the product of Preparation Example 1 is not added, the liquor pick-up, for the same squeezing pressure, drops to 113%. The depth of shade is less in proportion with the liquor pick-up, and the dyeing as a whole is unlevel.

EXAMPLE 3

Untreated (grey-state) tubular knit in 50% cotton and 50% polyester fibre is padded at room temperature on a pad-mangle under a squeeze roller pressure of 3 bar with a liquor which contains per litre

- 20 g of the blue reactive dyestuff from lines 41–50 in column 10 of U.S. Pat. No. 4,043,997,
- 10 g of a commercially available wetting agent,
- 8 g of a 4.5% strength solution of the product described in Preparation Example 1, and
- 20 g of anhydrous sodium carbonate.

The fixing alkali (sodium carbonate) is metered into the box in the form of an aqueous solution using a metering pump. The liquor pick-up is 130%.

The padded cloth is wrapped up air-tight without edge overlap and is left to rotate slowly at room temperature for 24 hours.

The aftertreatment is as in Examples 1 and 2. The cotton portion has been dyed in a full level blue shade.

Without addition of the abovementioned reaction product the liquor pick-up, using otherwise the same procedure, is only 88% and the dyed shade is correspondingly paler.

EXAMPLE 4

Grey-state tubular circular-knit fabric (sheared plush) in 80% cotton fibre and 20% nylon fibre is slit open and is then padded at room temperature in the open-width state on a pad-mangle under a roller pressure of 2.5 bar with a liquor which contains per liter:

- 15 g of the orange reactive dyestuff of Example 80 of DE-A-1,644,171
- 55 g of the red reactive dyestuff of Example 3 of DE-A-2,264,698
- 50 g of technical-grade urea
- 7 g of a commercially available anionic wetting agent
- 3 g of the product described in Preparation Example 1, in the form of its 4.5% by weight strength aqueous solution
- 20 g of anhydrous sodium carbonate
- 8 $cm^3$ of 32.5% by weight strength sodium hydroxide solution.

The fixing alkali (sodium carbonate/sodium hydroxide) is metered into the box in the form of an aqueous solution using a metering pump. The liquor pick-up is 110%.

The padded fabric is batched up with no edge overlap, is wrapped up air-tight and is left overnight to rotate at a low speed. After a short interim rinse of the cloth, the nylon portion can if necessary be dyed up as well in customary manner on exhaust dyeing machines. Conventional rinsing and soaping off produces a cotton portion dyed a full red of satisfactory levelness.

Without the addition of the product described in Preparation Example 1, the same procedure produces a liquor pick-up of only 95%. The depth of shade is correspondingly less.

EXAMPLE 5

Grey-state cotton interlock in tubular form is padded at room temperature on a pad-mangle for jersey under a squeeze roller pressure of 4 bar with a liquor which contains per liter:

- 30 g of the blue reactive dyestuff of Example 2 of DE-A-1,644,171,
- 10 g of a commercially available wetting agent
- 5 g of the product described in Preparation Example 1, in the form of its 4.5% by weight strength aqueous solution
- 10 g of neutral salt (sodium chloride or sodium sulphate)
- 20 g/l of anhydrous sodium carbonate.

The fixing alkali is added directly in the form of an aqueous solution to the direct dyestuff/auxiliary solution.

The liquor pick-up is 130%. The dyestuff is fixed by steaming at 103° C. with saturated steam for 2 minutes.

The customary rinse and soap-off at the boil produces a level blue dyeing having very good fastness properties.

Without the addition of the product described in Preparation Example 1 the same procedure produces a liquor pick-up of only 105%. The depth of shade of the dyeing is correspondingly less. In addition, the levelness of the dye is unsatisfactory. It is evident, in particular if the conditions on a practical steamer are considered, that the liquor is additionally shifted about on the cloth by the squeezing action of deflecting elements (rollers and so on) within the steamer, and thus is the cause of an unlevel dyeing. By contrast, the ability of the cloth to hold more liquor as a result of the addition of the product described in Preparation Example 1 leads to a satisfactory dyeing result.

We claim:

1. Process for dyeing cellulose fibres or fibre blends containing cellulose fibres with reactive dyestuffs by a cold pad-batch or pad-steam method, characterised in that the fibres are treated with aqueous padding liquors which contain water-soluble reaction products of copolymers of maleic anhydride and ethylene, propylene, isobutylene, diisobutylene or styrene with ammonia or amines of the formula

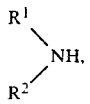

I in which $R^1$ and $R^2$ stand for hydrogen, $C_1$–$C_4$-alkyl or $C_1$–$C_4$-hydroxyalkyl.

2. Process according to claim 1, characterised in that the padding liquors contain water-soluble reaction products of copolymers of maleic anhydride and styrene with ammonia or amines of claim 1.

3. Process according to claim 1, characterised in that the padding liquor contains water-soluble reaction products of copolymers of maleic anhydride and styrene with ammonia.

4. Process according to claim 1, characterised in that the copolymers used contain maleic anhydride and styrene in a molar ratio of 1:1 and have a molecular weight of $0.5\times10^5$–$9.0\times10^6$.

5. Process according to claim 1, characterised in that the textiles in web form are tubular knits in cellulose fibres or fibre blends containing cellulose fibres.

6. Agents for dyeing cellulose fibres or fibre blends containing cellulose fibres, characterised in that they contain water-soluble reaction products of copolymers of maleic anhydride and ethylene, propylene, isobutylene, diisobutylene or styrene with ammmonia or amines of the formula

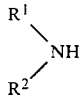

in which $R^1$ and $R^2$ stand for hydrogen, $C_1$–$C_4$-alkyl or $C_1$–$C_4$-hydroxyalkyl.

7. A process according to claim 1, wherein the reaction product contains recurring units of the formula

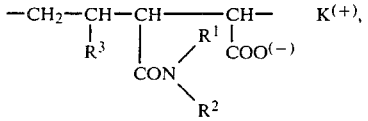

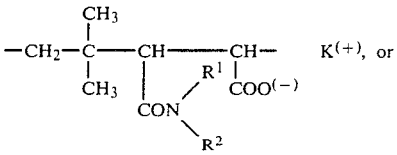

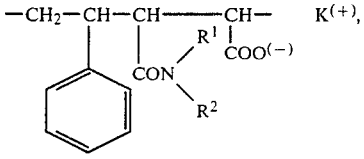

wherein $R^3$ is hydrogen, methyl or $—CH_2—C(CH_3)_3$ and $K^{(+)}$ is hydrogen, an alkali metal ion or an ammonium ion of the formula

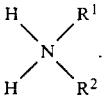

8. A process according to claim 1, wherein the molecular weight of the reaction product is $1.0\times10^6$ to $8.0\times10^6$.

9. A process according to claim 1, wherein the concentration of the padding liquors is 2 to 30% by weight.

10. A process according to claim 1, wherein the reaction products are added to the padding liquors in amounts of 0.1 to 5 g/l.

11. A process according to claim 1, wherein the reaction products are added to the padding liquors in amounts of 0.4 to 1.0 g/l.

12. A process according to claim 1, wherein the reaction products are added to the padding liquors combined with epsilon-caprolactam or urea in a weight ratio of 1:0.5 to 1:2.

13. A process according to claim 1, wherein the padding liquors contain acid binding agents.

14. A process according to claim 1 wherein said binding agent is an alkali.

15. A process according to claim 1, wherein the padding liquors contain auxiliaries.

16. A process according to claim 15, wherein said auxiliary is a wetting agent.

* * * * *